US008482198B1

(12) United States Patent
Boroczki et al.

(10) Patent No.: US 8,482,198 B1
(45) Date of Patent: Jul. 9, 2013

(54) HIGH INTENSITY DISCHARGE LAMP WITH IMPROVED STARTABILITY AND PERFORMANCE

(75) Inventors: Agoston Boroczki, Budapest (HU); Peter Akos, Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/329,878

(22) Filed: Dec. 19, 2011

(51) Int. Cl.
*H01J 17/20* (2006.01)

(52) U.S. Cl.
USPC ..... 313/576; 313/633; 313/638; 313/643

(58) Field of Classification Search
None
See application file for complete search history.

(56) References Cited

U.S. PATENT DOCUMENTS

| | | | | |
|---|---|---|---|---|
| 5,625,256 | A | 4/1997 | Tiedt et al. | |
| 5,838,104 | A | 11/1998 | Rutan et al. | |
| 5,866,982 | A | 2/1999 | Scott et al. | |
| 6,346,495 | B1 | 2/2002 | Dynys et al. | |
| 6,362,571 | B1 * | 3/2002 | Suijker et al. | 313/637 |
| 6,483,241 | B1 | 11/2002 | Stockwald | |
| 6,833,677 | B2 * | 12/2004 | Jackson et al. | 313/642 |
| 6,965,202 | B2 | 11/2005 | Hataoka et al. | |
| 7,057,350 | B2 | 6/2006 | Lambrechts et al. | |
| 7,215,081 | B2 | 5/2007 | Bewlay et al. | |
| 2002/0185973 | A1 * | 12/2002 | Jackson et al. | 313/607 |
| 2006/0164017 | A1 | 7/2006 | Rintamaki et al. | |
| 2009/0001887 | A1 | 1/2009 | Takeuchi et al. | |
| 2009/0146570 | A1 | 6/2009 | He et al. | |
| 2009/0146571 | A1 | 6/2009 | Russell et al. | |
| 2010/0013417 | A1 | 1/2010 | Ramaiah et al. | |
| 2011/0266947 | A1 * | 11/2011 | Tu | 313/573 |

FOREIGN PATENT DOCUMENTS

| | | |
|---|---|---|
| EP | 0670588 | 9/1995 |
| WO | 9953522 | 10/1999 |
| WO | 9953523 | 10/1999 |

OTHER PUBLICATIONS

International Search Report and Written Opinion for corresponding PCT application No. PCT/US2012/069357, dated Feb. 26, 2013.

* cited by examiner

*Primary Examiner* — Ashok Patel
(74) *Attorney, Agent, or Firm* — Pearne & Gordon LLP

(57) ABSTRACT

A lamp includes a discharge vessel; electrodes spaced apart in the discharge vessel comprising tungsten or tungsten alloy; and a fill sealed within the vessel having a pressure between 50-200 mbar. The fill includes: a starting gas which comprises: xenon, krypton, argon or combinations thereof with the exception of pure argon; optionally radioactive $Kr^{85}$ with a maximum activity level of 0.124 MBq/l as part of the starting gas; and a metal halide component. The lamp includes an active tungsten regeneration cycle wherein the fill comprises a species of the tungsten or tungsten alloy of material of the electrodes during lamp operation, wherein the solubility of tungsten or components of tungsten alloy in the tungsten or tungsten alloy species is lower in a gas phase adjacent to the electrodes than at close proximity of the wall of the discharge vessel.

27 Claims, 1 Drawing Sheet

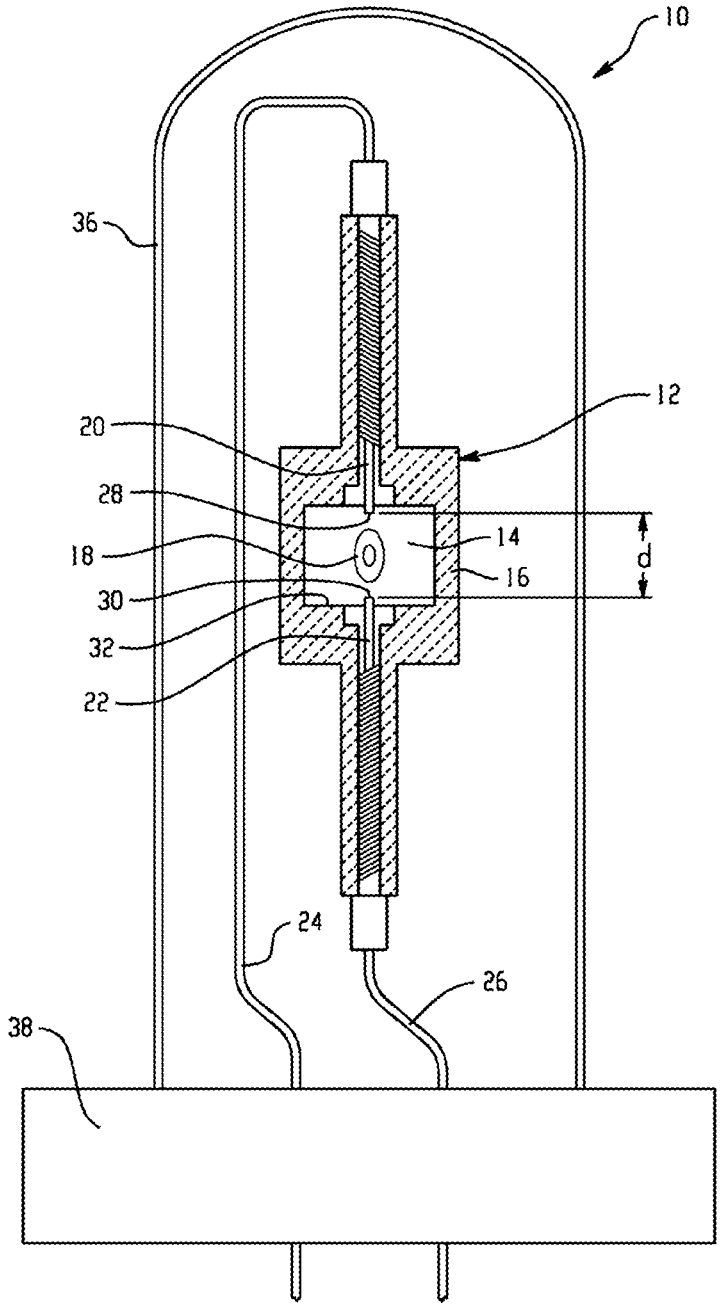
10
36
12
20
28
14
18
16
d
30
32
22
24
26
38

HIGH INTENSITY DISCHARGE LAMP WITH IMPROVED STARTABILITY AND PERFORMANCE

FIELD OF THE INVENTION

This disclosure features a High Intensity Discharge (HID) lamp which through the unique selection of the composition of the fill will minimize its radioactive $Kr^{85}$ content while still exhibit good startability, performance, and luminous flux maintenance over useful lamp life.

The present disclosure relates to a discharge lamp, more specifically a High Intensity Discharge (HID) lamp, with high luminous flux maintenance over useful lamp life, improved startability and improved performance under steady-state operation. It finds particular application in connection with a Ceramic Metal Halide (CMH) lamp with an active tungsten regeneration cycle, for example, by the help of including a source of available oxygen in the discharge vessel, which cycle maintains a difference in solubility for tungsten species in the gas or vapor phase between close proximity of the discharge vessel wall and at the electrodes in operational state of the lamp.

BACKGROUND OF THE INVENTION

High Intensity Discharge (HID) lamps are high-efficiency lamps that can generate large amounts of light from a relatively small source. These lamps are widely used in many applications, including highway and road lighting, lighting of large venues such as sports stadiums, floodlighting of buildings, shops, industrial buildings, automotive headlamps and video projectors, to name but a few. The term "HID lamp" is used to denote different kinds of lamps. These include Mercury Vapor lamps, Metal Halide lamps, and High Pressure Sodium lamps. Metal Halide lamps, in particular, are widely used in areas that require a high level of brightness and excellent color quality at relatively low cost. HID lamps differ from other types of lamps because their functioning requires operation at high temperature and high pressure over a prolonged period of time. Also, due to their usage and cost, it is desirable that these HID lamps have relatively long useful lives and produce a consistent level of brightness and color of light. Although in principle, HID lamps can operate with either an alternating current (AC) supply or a direct-current (DC) supply, in practice, the lamps are usually driven via an AC supply.

Discharge lamps produce light by ionizing a mixture of gaseous and vapor phase fill material, such as a mixture of rare gases, metal halides and mercury with an electric arc passing between two electrodes. The electrodes and the fill material are sealed within a translucent or transparent discharge vessel, which defines an interior chamber also called as a discharge chamber. The sealed discharge chamber maintains the pressure of the energized fill material and allows the emitted light to pass through its translucent or transparent wall. The fill material, also known as a "dose," emits a desired spectral power density distribution in response to being excited by the electric arc. For example, metal halides provide spectral power density distributions that offer a broad choice of light properties, e.g. color temperatures, color rendering indices, and luminous efficacies.

Such lamps often have a high initial light output that diminishes considerably over time basically due to blackening of the discharge chamber walls. The blackening is principally caused by tungsten and tungsten alloy particles of the electrode material transported from the electrodes to the discharge chamber wall. It has been proposed to incorporate a calcium oxide or tungsten oxide oxygen dispenser in the discharge vessel, as disclosed, for example in WO 99/53522 and WO 99/53523 by Koninklijke Philips Electronics N.V. Lamps produced according to the proposals in these applications may not, however, simultaneously meet increased expectations set against lamp efficacy, color hue and color quality of emitted light, color consistency and temporal color stability, luminous flux maintenance over useful lamp life, and reliability measures for a commercial lamp.

In addition to the issues associated with discharge chamber wall blackening, improved startability (i.e., reduced starting time, increased starting reliability, hot re-start capability, etc.) of HID lamps has recently become an important problem in the art. In this regard, lamp constructions having both good startability and high performance under steady-state operating conditions have required some compromise. This is largely due to the fact that physical, chemical and electrical conditions of the lamp at these two different phases of operation are considerably different.

Initially, the gas fill contained in the discharge vessel of a discharge lamp is electrically non-conductive. If an electric potential is applied on the electrodes of the lamp, this creates a favorable situation to strip the outer orbital electrons from the atoms of the gas fill (ionization of gas atoms) or from the crystal lattice of the electrode material and thus create free electrons, which are then accelerated though the gas by the electric field generated between the electrodes. This initiates the creation of more free electrons by collision with other gas atoms, which in turn are also ionized. If the applied electric field strength is high enough, high fraction of new electrons thus created will create additional electrons by inelastic collisions with gas atoms and ions in the fill, and initiate an electron avalanche. Such an avalanche finally creates the self-sustaining electric discharge in the lamp. However, to create such free electrons by simple dielectric breakdown of the gas fill by the strong electric field requires several tens of kilovolts of electric potential to be applied to the electrodes. Higher electric potentials require more expensive external electrical circuitry, and may not be commercially feasible. Unwanted breakdown can also occur in the outer jacket and in the cap-base region of the lamp, which may even completely inhibit starting.

Discharges for commercial lighting applications employ an additional initial source of free electrons, which removes the need for generating such high voltages to initiate the phase of discharge formation. Such external sources can be a heated filament, use of ever present cosmic rays, or providing a source of electrons by radioactive decay. Heated filaments are not practical in High Intensity Discharge (HID) lamps, and the cosmic ray background radiation is usually insufficient or of unreliably random nature to dramatically reduce the need for very high electric fields needed to initiate lamp ignition, unless other methods are used to lower the breakdown voltage.

For providing an initial source of free electrons by radioactive decay, typically what has been used in the past in the HID discharge vessel is a radioactive gas, such as $Kr^{85}$ with most of the decay products being beta particles (i.e., electrons). $Kr^{85}$ has a half-life of 10.8 years, with 99.6% of the decay products being beta particles (i.e., electrons) having a maximum kinetic energy of 687 keV. These electrons have very high energy, and in many respects are ideal sources for free electrons and are used widely as such for these applications. But to provide enough of these high energy electrons by radioactive decay, a significant quantity of this gas has been used in HID lamps.

The presence of $Kr^{85}$ in such lamps diminishes the need for providing very high electric potential on the electrodes, which makes the external electrical circuitry (i.e., a ballast) and systems design simpler and the whole lighting system more cost effective. Typical applications use such a radioactive gas with a starter/ignitor unit built into or applied separately along with a ballast that provides a high electric pulse for a very short duration of time, typically in the millisecond (or several hundred microseconds) range, which is very effective in creating the electron avalanche referred to earlier. However, recent UN2911 government regulations limit the amount of radioactive $Kr^{85}$ used in lamps. These regulations proscribe the HID lamp manufacturers from using the large quantity of $Kr^{85}$ gas that has been previously used, as described in preceding paragraph. Consequently, the minimization and/or elimination of $Kr^{85}$ from the fill gas of HID lamps is now required.

This disclosure provides a new and improved Metal Halide lamp with improved luminous flux maintenance over useful lamp life, startability and performance under steady-state lamp operation.

BRIEF DESCRIPTION

In one aspect, a lamp includes a discharge vessel, which defines an interior chamber also called as a discharge chamber in it. Electrodes comprising tungsten or tungsten alloy are spaced apart in the discharge vessel. A fill is also sealed within the discharge vessel. Portions of the fill are ionizable. The fill has a pressure between 50-200 mbar. The fill includes a starting gas which is selected from the group consisting of argon, krypton (as described herein the term krypton is meant to describe non-radioactive krypton unless stated otherwise), xenon or combinations thereof, and optionally radioactive $Kr^{85}$ with a maximum activity level of 0.124 MBq/l as part of the starting gas. The fill may optionally also include a voltage riser component, such as mercury, zinc halide, zinc, or gallium halide, and one or more metal halide compounds (e.g., comprising a rare earth halide selected from the group consisting of lanthanum halides, cerium halides, praseodymium halides, neodymium halides, samarium halides, europium halides, gadolinium halides, and combinations thereof). The pressure of the fill referred to herein is when the lamp is in "off" state at room temperature, and is substantially the same as the pressure of the starting gas component in the fill.

When the dominant halogen species in the above mentioned halide compounds is iodine, a source of available oxygen is also present in the vessel. The role of oxygen in the fill is to ensure existence of an active tungsten regeneration cycle in an operating lamp. However, if a dominant halogen species in the fill other than iodine is used, dosing the lamp with oxygen may be optional. For an active tungsten regeneration cycle to be maintained, there must be a difference in solubility of the tungsten species present in the gas phase at close proximity of the wall of the discharge chamber and close to at least a portion of at least one of the electrodes. When the dominant halogen species in metal halide compounds of the fill is bromine or chlorine, the above mentioned difference in gas phase tungsten solubility may also be realized without a source of available oxygen, depending also on the type of other components in the fill.

In another aspect, a lamp includes a discharge vessel. Electrodes comprising tungsten or tungsten alloy are spaced apart in the discharge vessel. A fill is sealed within the vessel having a pressure between 50-200 mbar. The fill includes a starting gas which is completely void of argon comprising: at least one of xenon and krypton; and optionally radioactive $Kr^{85}$ with a maximum activity level of 0.124 MBq/l as part of the starting gas. The fill may optionally also include a voltage riser component, such as mercury, one or more metal halide compounds (e.g., comprising a rare earth halide), and a source of oxygen (e.g., selected from a lanthanide oxide or an oxide of tungsten) when the dominant halogen in the halide compounds is iodine within the discharge vessel.

The fill can include a dose of mercury or it can be mercury free. When mercury free, the fill can include a substance of high cross section of momentum transfer for electron collisions, e.g., zinc halide, zinc in a metallic form, or gallium halide. Such species in the fill of metal halide lamps are often referred to as "voltage riser" or "buffer" components of the fill. These additives are different from the starting gas component of the fill, which is sometimes also referred to as "buffer gas". However, while the "starting gas" acts as an electron kinetic energy regulator during the starting phase of lamp operation, the "voltage riser" fill ingredients are responsible to set the voltage of the lamp mostly under steady-state lamp operating conditions.

In another aspect, a lamp includes a discharge vessel. Electrodes comprising tungsten or tungsten alloy extend into the discharge vessel. A fill is sealed within the vessel and has a pressure between 50-200 mbar. The fill includes a starting gas which is selected from the group consisting of argon, krypton, xenon and combinations thereof, and optionally radioactive $Kr^{85}$ with a maximum activity level of 0.124 MBq/l as part of the starting gas. The fill optionally also includes a voltage riser component, such as mercury zinc halide, zinc, of gallium halide, and one or more metal halide compounds comprising a rare earth halide selected from the group consisting of lanthanum halides, cerium halides, praseodymium halides, neodymium halides, samarium halides, europium halides, gadolinium halides, and combinations thereof. The fill also includes at least one compound selected from the group consisting of a) an alkaline metal halide, b) an alkaline earth metal halide, other than magnesium, and c) a halide of an element selected from gallium, indium and thallium. In the case where the dominant halogen type in the halide compounds is iodine, a source of oxygen (e.g., selected from a lanthanide oxide or an oxide of tungsten) is also present within the discharge vessel in a sufficient amount to maintain a concentration of $WO_2X_2$ in a vapor phase in the fill during lamp operation of at least $1\times10-9$ μmol/$cm^3$.

In another aspect, a method of forming a lamp includes providing a discharge vessel, providing electrodes comprising tungsten or tungsten alloy that extend into the discharge vessel, and sealing a fill within the vessel. The fill includes a starting gas including optionally radioactive $Kr^{85}$ with a maximum activity level of 0.124 MBq/l. The fill includes optionally a voltage riser component, such as mercury, zinc halide, zinc, or gallium halide, and a metal halide component comprising a rare earth halide selected from the group consisting of lanthanum halides, cerium halides, praseodymium halides, neodymium halides, samarium halides, europium halides, gadolinium halides, and combinations thereof. Further, a source of available oxygen may also be sealed in the discharge vessel. The source of available oxygen is present in an amount such that the solubility of tungsten species in the fill during lamp operation is lower in the gas phase adjacent to at least a portion of at least one of the electrodes than at close proximity of the wall of the discharge chamber, such that tungsten from the electrode that would otherwise be deposited on the discharge chamber wall during lamp operation is transported back to at least one of the electrodes.

In one embodiment, the lamp of the present invention includes a discharge vessel, electrodes spaced apart in the discharge vessel made of tungsten or tungsten alloy, a fill sealed within the vessel having a pressure between 50-200 mbar, the fill including: a starting gas comprising: xenon, krypton, argon or combinations thereof with the exception of pure argon; optionally radioactive Kr85 with a maximum activity level of 0.124 MBq/l as part of the starting gas; and a voltage riser component; and a metal halide component; and an active tungsten regeneration cycle wherein the fill comprises a species of the tungsten or the tungsten alloy of material of the electrodes during lamp operation, wherein the solubility of tungsten or components of tungsten alloy in the tungsten or tungsten alloy species is lower in the gas phase adjacent to the electrodes than at close proximity of the wall of the discharge chamber. In all embodiments herein, "in close proximity of the wall of the discharge chamber" can include at the wall of the discharge chamber.

In another embodiment, the lamp of the present invention includes a discharge vessel, electrodes spaced apart in the discharge vessel made of tungsten or tungsten alloy, a fill sealed within the vessel having a pressure between 50-200 mbar, the fill including: a starting gas comprising: 85-95% argon and 15-5% xenon; optionally radioactive Kr85 with a maximum activity level of 0.124 MBq/l as part of the starting gas; and a voltage riser component; and a metal halide component; and an active tungsten regeneration cycle wherein the fill comprises a species of the tungsten or the tungsten alloy of material of the electrodes during lamp operation, wherein the solubility of tungsten or components of tungsten alloy in the tungsten or tungsten alloy species is lower in the gas phase adjacent to the electrodes than at close proximity of the wall of the discharge chamber.

In another embodiment, the lamp of the present invention includes a discharge vessel, electrodes spaced apart in the discharge vessel made of tungsten or tungsten alloy, a fill sealed within the vessel having a pressure between 50-200 mbar, the fill including: a starting gas comprising: 70-95% argon and 30-5% krypton; optionally radioactive Kr85 with a maximum activity level of 0.124 MBq/l as part of the starting gas; and a voltage riser component; and a metal halide component; and an active tungsten regeneration cycle wherein the fill comprises a species of the tungsten or the tungsten alloy of material of the electrodes during lamp operation, wherein the solubility of tungsten or components of tungsten alloy in the tungsten or tungsten alloy species is lower in the gas phase adjacent to the electrodes than at close proximity of the wall of the discharge chamber.

In yet another embodiment, the lamp of the present invention includes a discharge vessel, electrodes spaced apart in the discharge vessel made of tungsten or tungsten alloy, a fill sealed within the vessel having a pressure between 50-200 mbar, the fill including: a starting gas which is completely void of argon comprising: at least one of xenon and krypton; optionally radioactive Kr85 with a maximum activity level of 0.124 MBq/l as part of the starting gas; and a voltage riser component; and a metal halide component; and an active tungsten regeneration cycle wherein the fill comprises a species of the tungsten or the tungsten alloy of material of the electrodes during lamp operation, wherein the solubility of tungsten or components of tungsten alloy in the tungsten or tungsten alloy species is lower in the gas phase adjacent to the electrodes than at close proximity of the wall of the discharge chamber.

In another embodiment, the lamp of the present invention includes a discharge vessel, electrodes spaced apart in the discharge vessel made of tungsten or tungsten alloy, a fill sealed within the vessel having a pressure between 50-200 mbar, the fill including: a starting gas comprising: 55-10% argon, 15-5% xenon and 30-5% krypton; optionally radioactive Kr85 with a maximum activity level of 0.124 MBq/l as part of the starting gas; and a voltage riser component; and a metal halide component; and an active tungsten regeneration cycle wherein the fill comprises a species of the tungsten or the tungsten alloy of material of the electrodes during lamp operation, wherein the solubility of tungsten or components of tungsten alloy in the tungsten or tungsten alloy species is lower in the gas phase adjacent to the electrodes than at close proximity of the wall of the discharge chamber.

One advantage of at least one embodiment is the provision of a ceramic discharge vessel fill with improved performance and luminous flux maintenance over useful lamp life.

Another advantage of at least one embodiment resides in reduced wall blackening of the discharge vessel.

Another advantage is that a tungsten regeneration cycle is maintained between a wall of a discharge chamber and a portion of an electrode that is operating at a higher temperature than the discharge chamber wall.

Another advantage is improved startability.

Another advantage is that the reduction in fill pressure to the 50-200 mbar pressure range allows electric breakdown of the fill gas in the discharge vessel to occur at lower starting voltages applied on the electrodes of the lamp.

Another advantage is reduction or potentially full elimination of radioactive $Kr^{85}$ fill of the discharge vessel needed to ensure reliable starting of the lamp.

Yet another advantage is that the complete or partial replacement of argon with xenon, krypton or combinations thereof keeps heat conduction losses from the arc towards the discharge vessel wall low at steady state lamp operating conditions.

Still further advantages will become apparent to those of ordinary skill in the art upon reading and understanding the following detailed description of the preferred embodiments.

BRIEF DESCRIPTION OF THE DRAWINGS

FIG. 1 is a cross-sectional view of an HID lamp according to the exemplary embodiment.

DETAILED DESCRIPTION

Aspects of an exemplary embodiment relate to a fill for a lamp that is formulated for improved startability. The exemplary embodiment provides a lamp with a reduced pressure fill that contains either: 1) xenon or krypton and is completely void of argon; or 2) an argon/xenon, an argon/krypton or an argon/krypton/xenon mix. Additionally, the fill is formulated to promote a tungsten regeneration cycle by enabling a higher solubility of tungsten species in the gas phase fill adjacent to the discharge chamber wall of the lamp, where tungsten deposition would otherwise occur, than in the gas phase fill close to the electrode, even though the electrode operates at a substantially higher temperature than the vessel wall.

With reference to FIG. 1, a cross-sectional view of an exemplary HID lamp 10 is shown. The lamp includes a discharge vessel or arc tube 12, which defines an interior chamber, also called as a discharge chamber, 14. The discharge vessel 12 has a wall 16, which may be formed of a ceramic material, such as alumina, or other suitable light-transmissive material, such as quartz glass. A fill 18 is sealed in the discharge chamber 14. Electrodes comprising tungsten or tungsten alloy 20, 22 are positioned at opposite ends of the discharge vessel so as to energize the fill when an electric current is applied thereto. The two electrodes 20 and 22 are typically fed with an alternating electric current via conductors 24, 26

(e.g., from a ballast, not shown). Tips 28, 30 of the electrodes 20, 22 are spaced by a distance "d", which defines the arc gap. When the HID lamp 10 is powered, a voltage difference is created across the two electrodes. This voltage difference causes an electric breakdown in the originally insulating gas fill in the discharge chamber 14 and finally creates a self-sustaining electric arc plasma discharge across the gap between the tips 28, 30 of the electrodes. Visible light is generated and passes out of the discharge chamber 14, through the light-transmitting vessel wall 16.

The electrodes become heated during lamp operation and tungsten tends to vaporize from the tips 28, 30. Some of the vaporized or chemically transported tungsten may deposit on an interior surface 32 of the vessel wall 16. Absent a tungsten regeneration cycle, the deposited tungsten may lead to vessel wall blackening and a reduction in the transmission of the vessel wall 16 for visible light emitted by the arc discharge.

While the electrodes 20, 22 may be formed from pure tungsten, e.g., greater than 99% pure tungsten, it is also contemplated that the electrodes may have a lower tungsten content, e.g., may comprise at least 50% or at least 95% tungsten.

The exemplary discharge vessel 12 is surrounded by an outer bulb 36 that is provided with a lamp cap 38 at one end, through which the lamp is connected with a source of power (not shown), such as to the mains voltage. The outer bulb 36 may be formed of glass or other suitable material. The lighting assembly formulated with an exemplary HID lamp 10 also includes a ballast (not shown), which acts as a starter when the lamp is switched on and as a current limiter/controller often with the additional function of power regulation in operational state of the lamp. The ballast is included in an electrical circuit that includes the lamp and the power source. The space between the discharge vessel and outer bulb may be evacuated or gas filled. Optionally a shroud (not shown) formed from quartz or other suitable material, surrounds or partially surrounds the discharge vessel to contain possible discharge vessel fragments in the event of rupture of the discharge vessel.

The discharge chamber 14 has a volume commensurate with rated wattage of the lamp and sustainable wall loading of the discharge vessel. For example, for a 70 W lamp, the volume may be about 0.15 $cm^3$ to about 0.35 $cm^3$, e.g., about 0.25 $cm^3$, and for a 250 W lamp, the volume may be about 1.0 $cm^3$ to about 3.0 $cm^3$, e.g., about 2.0 $cm^3$.

In one embodiment the fill 18 may include a starting gas, optionally traces of radioactive $Kr^{85}$ with a maximum activity level of 0.124 MBq/l as part of the starting gas, and a metal halide component. In some embodiments, the fill may include a source of available oxygen, which may be present e.g. as a solid oxide. In some embodiments, the fill may include mercury (Hg). In some embodiments, the fill may include additional source of available halogen. The components of the fill 18 and their respective amounts may be selected to provide a higher solubility of tungsten species in gas or vapor phase at close proximity of the wall surface 32 for reaction with any tungsten deposited there. The metal halide component includes a rare earth halide and may further include one or more of an alkaline metal halide, an alkaline earth metal halide, and a Group IIIA halide (gallium and/or indium and/or thallium halide). In operation, the electrodes 20, 22 produce an arc between tips 28, 30 of the electrodes, which ionizes the fill to produce a plasma in the discharge space of the discharge chamber. The emission characteristics of the light produced are dependent, primarily, upon the constituents of the fill material, the voltage across the electrodes, as well as upon the temperature distribution of the pressure inside, and the geometry of the discharge vessel.

The starting gas may be an inert gas, such as argon, xenon, krypton, or combination thereof, and may be present in the fill at a pressure between 50-200 mbar of the discharge chamber 14. In one embodiment, the lamp is filled with a mixture of 85-95% argon and 15-5% xenon, where percent compositions are always given in molar percent. In another embodiment, the lamp is backfilled with a mixture of 70-95% argon and 30-5% krypton. In one embodiment, the lamp is filled with a mixture of 55-10% argon, 15-5% xenon and 30-5% krypton. In another embodiment, the starting gas is completely void of argon and contains either xenon or krypton. Optionally, reduced amounts of $Kr^{85}$ with a maximum activity level of 0.124 MBq/l may be used as part of the starting gas. The radioactive $Kr^{85}$ provides ionization that assists in starting the lamp. $Kr^{85}$ generates free charge carriers in the fill gas of the discharge chamber to initiate multiplication of charged particles, and finally an electron avalanche between the two opposing electrodes. It is unexpected and is against prior art to replace argon with xenon or krypton in the starting gas of Metal Halide lamps, despite the fact that any noble gas may generally be considered as equally valid candidates for this function due to their low chemical reactivity and stable electron shell structure. Moreover, xenon, for example, even has a lower ionization energy level than argon, which would imply easier starting in xenon than in argon fill gas. However, because xenon and krypton atoms are heavier than argon atoms, the kinetic energy loss of an electron in the electron-atom elastic collisions is higher. This results in lower average electron kinetic energy and lower probability of ionizing xenon and krypton atoms than argon atoms during the starting phase of a Metal Halide lamp, assuming same fill pressure. In other words, electrons are slowed down more efficiently in elastic collisions with heavier starting gas atoms than the lower ionization energy level of these more massive atoms would increase probability of ionization, and consequently, a reliable starting.

To increase the average electron kinetic energy in the electron avalanche at the same accelerating electric field strength, i.e. starting voltage, the mean free path of electrons is to be increased by e.g. reducing fill pressure of starting gas. The reduced fill gas pressure may be about 50-200 mbar, although higher cold fill pressures are not excluded. As described above, high fill gas pressures above 200 mbar increases the de-ionization losses in the starting gas which leads to an increase in the minimum number of free charge carriers needed to initiate the electron avalanche. Conversely, when the fill gas pressure is reduced to 50-200 mbar, de-ionization losses are also decreased and the required minimum number of free charge carriers may be lowered. Decreased pressure of the fill gas compensates for the use of heavier xenon, and causes the electrons to accelerate, resulting in improved starting. By lowering the fill gas pressure the concentration of $Kr^{85}$ may be reduced or avoided completely.

However, when using lower fill gas pressure, tungsten or tungsten alloy transport due to sputtering, evaporation and chemical transport of particles from the tungsten electrodes onto the inside surface of the discharge chamber wall occurs to a greater extent, which accelerates its blackening and loss of emitted light from the lamp. Therefore, to overcome this difficulty, this disclosure features the use of compounds discussed herein that facilitate the tungsten halogen clean-up cycle. Close to the wall of the discharge chamber there are halide compounds (e.g., halides of iodide) and in some embodiments added oxygen compounds. This results in formation of tungsten halides and tungsten oxyhalides near the discharge chamber wall, which molecules migrate to the electrodes allowing tungsten to be transported back into the electrodes.

When reducing fill gas pressure, heat insulation efficiency of the fill gas at run-up, and most importantly, at steady-state operating conditions is also reduced. As a consequence, heat conduction losses from the arc towards the discharge vessel walls are increased, power balance of the arc becomes less favorable and efficacy of the lamp drops. However, if the conventionally used argon fill gas is replaced by a heavier noble gas, like xenon or krypton, heat conduction losses due to lower fill pressure may be recovered by the help of lower heat conductivity of these heavier noble gas atoms. Using xenon may result in a hotter arc and the lamp having greater efficiency (i.e., generating more luminous flux per unit input power).

In one embodiment, the metal halide component may be present at from about 10 to about 90 mg/cm$^3$ of discharge chamber volume, e.g., about 25-55 mg/cm$^3$. A ratio of metal halide dose to mercury can be, for example, from about 1:5 to about 15:1, expressed by weight. The halide(s) in the metal halide component can each be selected from chlorides, bromides, iodides and combinations thereof. In one embodiment, the metal halides are all iodides. The metal halide compounds usually will represent stoichiometric relationships. However, slight deviation from stoichiometry may also be possible and of advantage.

In one embodiment, the rare earth halide of the halide component is one that is selected in type and concentration such that it does not form a stable oxide by reactions with the optional source of oxygen, i.e., it is desirable to form an unstable oxide. By this it is meant that the metal halide component permits available oxygen to exist in the fill during lamp operation. Exemplary rare earth halides which form unstable oxides include halides of lanthanum (La), cerium (Ce), praseodymium (Pr), neodymium (Nd), samarium (Sm), europium (Eu), gadolinium (Gd), and combinations thereof. The rare earth halide(s) of the fill can have the general form $REX_3$, where RE is selected from La, Ce, Pr, Nd, Sm, Eu and Gd, and X is selected from Cl, Br, and I, and combinations thereof.

The alkaline metal halide, where present, may be selected from lithium (Li), sodium (Na), potassium (K), and cesium (Cs) halides, and combinations thereof. In one specific embodiment, the alkaline metal halide includes sodium halide. The alkaline metal halide(s) of the fill can have the general form AX, where A is selected from Li, Na, K, and Cs, and X is as defined above, and combinations thereof.

The alkaline earth metal halide, where present, may be selected from calcium (Ca), strontium (Sr), and barium (Ba) halides, and combinations thereof. The alkaline earth metal halide(s) of the fill can have the general form $MX_2$, where M is selected from Ca, Sr, and Ba, and X is as defined above, and combinations thereof. In one specific embodiment, the alkaline earth metal halide includes calcium halide. In another embodiment, the fill is free of calcium halide.

The group IIIa halide, where present, may be selected from gallium (Ga), indium (In) and thallium (Tl) halides. In one specific embodiment, the group Ma halide includes thallium halide. The group IIIa halide(s) of the fill may have the general form LX or $LX_3$, where L is selected from Ga, In and Tl, and X is as defined above.

When present, the source of available oxygen is one that, under the lamp operating conditions, makes oxygen available for reaction with other fill components to form, for example, $WO_2X_2$. The source of available oxygen gas may be an oxide that is unstable under lamp operating temperatures, such as an oxide of tungsten, free oxygen gas ($O_2$), water, molybdenum oxide, mercury oxide, lanthanide oxide, or combination thereof. The oxide of tungsten may have the general formula $WO_nX_m$, where n is at least 1, m can be 0, and X is as defined above. Exemplary tungsten oxides include $WO_3$, $WO_2$, and tungsten oxyhalides, such as $WO_2I_2$. In general, most oxides of rare earth elements are not suitable sources of available oxygen as they are stable at lamp operating temperatures.

In one embodiment, the tungsten electrode is partially oxidized to form tungsten oxide, e.g., a spot on its surface is thermally oxidized prior to insertion into the lamp, to provide the source of available oxygen. In other embodiments, comminuted tungsten oxide, such as tungsten oxide chips, may be introduced in the fill.

In one embodiment, the source of available halogen, where present, is generally an unstable halide or other halogen containing compound, which is capable of increasing the concentration of vapor phase $WO_2X_2$, through one or more reactions occurring during lamp operation, where X is as defined above. The source of free halogen may be a compound capable of reacting directly or indirectly with tungsten metal, tungsten-containing species, or a compound of tungsten to form $WO_2X_2$. The source of available halogen may be a halide selected from mercury halides, such as $HgI_2$, $HgBr_2$, $HgCl_2$, and combinations thereof.

In general, the source of free halogen is not a rare earth halide or a halide of gallium, indium, thallium, lithium, sodium, potassium, rubidium, cesium, magnesium, calcium, strontium, or barium or any halide that binds the oxygen more tightly than tungsten, making it unavailable for reaction. In the case of iodides, the source of available halogen may be present in the fill at a total concentration, expressed in terms of its $I_2$ content of, for example, at least about 0.4 micromoles/cm$^3$, e.g., from 0.4-8 micromoles/cm$^3$ and in one embodiment, from about 1-4 micromoles/cm$^3$. In the case of $HgBr_2$ and $HgCl_2$ the $WO_2Br_2$ or $WO_2Cl_2$ complex formed during lamp operation is more stable than for the corresponding $WOI_2$ compound, and thus lower amounts of $HgBr_2$ or $HgCl_2$ can be used than for $HgI_2$. The source of available halogen may be present in sufficient quantity to provide an available halogen (e.g., $I_2$ or other reactive halogen species) concentration in the fill, during lamp operation, of at least about 0.2 micromoles/cm$^3$. As stated above, in the case if dominant halogen is bromine or chlorine in the fill, the source of available of oxygen may not even be required for an active tungsten regeneration cycle, and stable tungsten compounds formed at the wall are in the form of $W_nX_m$, where n and m are at least 1, and X is either bromine or chlorine.

In various embodiments, the lamp fill, when the lamp is formed, i.e., before operation, consists essentially of a starting gas, optionally $Kr^{85}$ with a maximum activity level of 0.124 MBq/l as part of the starting gas, optionally free mercury, optionally tungsten oxide, and a metal halide component consisting essentially of optionally mercury halide, a rare earth halide selected from the group consisting of lanthanum halides, cerium halides, praseodymium halides, neodymium halides, samarium halides, europium halides, gadolinium halides, and combinations thereof, and at least one of an alkali metal halide, an alkaline earth metal halide and a halide of an element selected from the group IIIa.

The fill is formulated to provide conditions which favor a tungsten regeneration cycle in the lamp, i.e., favor high solubility of tungsten in the gas phase of the fill 18 at close proximity of the discharge chamber wall 32 while favoring the re-deposition of the solubilized tungsten onto the electrode(s) 20, 22. The electrode temperature during lamp operation may be about 2500-3200 K at the electrode tip 28, 30, and in one embodiment, is maintained at a temperature of less than about 2700 K. Tungsten regeneration can be achieved by selecting the lamp fill to provide a higher solubility of tungsten species in the gas phase adjacent to the discharge chamber wall than close to the electrode tip. More information on this phenomenon can be found in U.S. Pub. Nos. 2009/0146570 and 2009/0146571.

The Ceramic Metal Halide discharge vessel 12 can be of a three part construction, and may be formed, for example, as described, for example, in any one of U.S. Pat. Nos. 5,866,982; 6,346,495; 7,215,081; and U.S. Pub. No. 2006/0164017. It will be appreciated that the discharge vessel 12 can be constructed from fewer or greater number of components, such as one or five components. The parts are formed as green ceramic and bonded in a gas tight manner by sintering or other suitable method. An exemplary discharge vessel can be constructed by e.g. die pressing, slip casting, injection molding, or extruding a mixture of a ceramic powder and a binder into a solid mold. The ceramic powder may comprise high purity alumina ($Al_2O_3$), optionally doped with magnesia, yttria, zirconia, or combination of thereof. Other ceramic materials which may be used include non-reactive refractory oxides and oxynitrides such as yttrium oxide, lutetium oxide, and hafnium oxide and their solid solutions and compounds with alumina such as yttrium-aluminum-garnet and aluminum oxynitride. Binders which may be used individually or in combination include organic polymers such as polyols, polyvinyl alcohol, vinyl acetates, acrylates, cellulosics and polyesters. Subsequent to green ceramic body forming, the binder is removed from the green part, typically by thermal pyrolysis, e.g., at about 900-1100° C., to form a bisque-fired part. The sintering step may be carried out by heating the bisque-fired parts in hydrogen at about 1800-2000° C. The resulting ceramic material comprises a densely sintered polycrystalline ceramic discharge vessel body.

In other embodiments, the discharge vessel is formed of quartz glass and can be formed of one piece.

The exemplary lamp finds use in a variety of applications, including automotive headlighting, highway and road lighting, lighting of large venues such as sports stadiums, floodlighting of buildings, shops, industrial buildings, and as a light source in projectors.

The invention has been described with reference to specific embodiments. Obviously, modifications and alterations will occur to others upon reading and understanding the preceding detailed description. It is intended that the invention be construed as including all such modifications and alterations.

What is claimed is:

1. A lamp comprising:
- a discharge vessel;
- electrodes spaced apart in the discharge vessel comprising tungsten or tungsten alloy;
- a fill sealed with the vessel having a pressure below 80 mbar, the fill comprising:
  - a starting gas which comprises: xenon, krypton, argon or combinations thereof with the exception of pure argon;
  - optionally radioactive Kr85 with a maximum activity level of 0.124 MBq/l as part of the starting gas;
  - a voltage riser component;
  - a metal halide component; and
- an active tungsten regeneration cycle wherein the fill comprises a species of said tungsten or said tungsten alloy of the electrode material during lamp operation, wherein the solubility of tungsten or components of tungsten alloy in said tungsten or tungsten alloy species is lower in the gas phase adjacent to the electrodes than at close proximity of the wall of the discharge vessel.

2. The lamp of claim 1, wherein the said tungsten or tungsten alloy species includes an element selected from the group consisting of iodine, bromine, chlorine, oxygen and combinations thereof.

3. The lamp of claim 1, the fill comprising a source of oxygen that is selected from a free oxygen gas ($O_2$), a molybdenum oxide, a mercury oxide, a lanthanide oxide, an oxide of tungsten, or a combination of thereof.

4. The lamp of claim 3, wherein the source of oxygen is an oxide of tungsten which comprises substantially $WO_3$.

5. The lamp of claim 3, wherein the source of oxygen is a free oxygen gas ($O_2$).

6. The lamp of claim 3, wherein the source of oxygen is mercury oxide.

7. The lamp of claim 1, wherein during lamp operation, said species of tungsten or tungsten alloy comprises $WO_2X_2$ in vapor form, where X is selected from Cl, Br and I.

8. The lamp of claim 1, wherein during lamp operation, said species of tungsten or tungsten alloy comprises $W_nX_m$ in vapor form, where n and m is at least 1, and X is selected from I, Br and Cl.

9. The lamp of claim 1, wherein said pressure is between 50-80 mbar.

10. The lamp of claim 1 comprising said radioactive Kr85 at said activity level.

11. A lamp comprising:
- a discharge vessel;
- electrodes spaced apart in the discharge vessel comprising tungsten or tungsten alloy;
- a fill sealed within the vessel having a pressure between 50-200 mbar, the fill comprising:
  - a starting gas comprising: 85-95% argon and 15-5% xenon;
  - optionally radioactive Kr85 with a maximum activity level of 0.124 MBq/l as part of the starting gas;
  - a voltage riser component;
  - a metal halide component; and
- an active tungsten regeneration cycle wherein the fill comprises a species of said tungsten or said tungsten alloy of the electrode material during lamp operation, wherein the solubility of tungsten or components of tungsten alloy in said tungsten or tungsten alloy species is lower in the gas phase adjacent to the electrodes than at close proximity of the wall of the discharge vessel.

12. The lamp of claim 11, wherein the species includes an element selected from the group consisting of iodine, bromine, chlorine, oxygen and combinations thereof.

13. The lamp of claim 11, wherein said pressure is between 50-150 mbar.

14. The lamp of claim 11 comprising said radioactive Kr85 at said activity level.

15. A lamp comprising:
- a discharge vessel;
- electrodes spaced apart in the discharge vessel comprising tungsten or tungsten alloy;
- a fill sealed with the vessel having a pressure between 50-200 mbar, the fill comprising:
  - a starting gas which comprises: 70-95% argon and 30-5% krypton;
  - optionally radioactive Kr85 with a maximum activity level of 0.124 MBq/l as part of the starting gas;
  - a voltage riser component;
  - a metal halide component; and
- an active tungsten regeneration cycle wherein the fill comprises a species of said tungsten or said tungsten alloy of the electrode material during lamp operation, wherein the solubility of tungsten or components of tungsten alloy in said tungsten or tungsten alloy species is lower in the gas phase adjacent to the electrodes than at close proximity of the wall of the discharge vessel.

16. The lamp of claim 15, wherein the species includes an element selected from the group consisting of iodine, bromine, chlorine, oxygen and combinations thereof.

17. The lamp of claim 15, wherein said pressure is between 50-150 mbar.

18. The lamp of claim 15 comprising said radioactive Kr85 at said activity level.

19. A lamp comprising:

a discharge vessel;

electrodes spaced apart in the discharge vessel comprising tungsten or tungsten alloy;

a fill sealed within the vessel having a pressure of less than 50-200 mbar, the fill comprising:

a starting gas which is completely void of argon comprising: at least one of xenon and krypton;

optionally radioactive Kr85 with a maximum activity level of 0.124 MBq/l as part of the starting gas;

a voltage riser component;

a metal halide component; and an active tungsten regeneration cycle wherein the fill comprises a species of said tungsten or said tungsten alloy of the electrode material during lamp operation, wherein the solubility of tungsten or components of tungsten alloy in said tungsten or tungsten alloy species is lower in the gas phase adjacent to the electrodes than at close proximity of the wall of the discharge vessel.

20. The lamp of claim 19, wherein the species includes an element selected from the group consisting of iodine, bromine, chlorine, oxygen and combinations thereof.

21. The lamp of claim 19, wherein said pressure is between 50-150 mbar.

22. The lamp of claim 19 comprising said radioactive Kr85 at said activity level.

23. A lamp comprising:

a discharge vessel;

electrodes spaced apart in the discharge vessel comprising tungsten or tungsten alloy;

a fill sealed with the vessel having a pressure between 50-200 mbar, the fill comprising:

a starting gas which comprises: 55-10% argon, 15-5% xenon and 30-5% krypton;

optionally radioactive Kr85 with a maximum activity level of 0.124 MBq/l as part of the starting gas;

a voltage riser component;

a metal halide component; and an active tungsten regeneration cycle wherein the fill comprises a species of said tungsten or said tungsten alloy of the electrode material during lamp operation, wherein the solubility of tungsten or components of tungsten alloy in said tungsten or tungsten alloy species is lower in the gas phase adjacent to the electrodes than at close proximity of the wall of the discharge vessel.

24. The lamp of claim 23, wherein said pressure is between 50-150 mbar.

25. The lamp of claim 23 comprising said radioactive Kr85 at said activity level.

26. The lamp of claim 23, wherein said pressure is between 50-80 mbar.

27. A lamp comprising:

a discharge vessel;

electrodes spaced apart in the discharge vessel comprising tungsten or tungsten alloy;

a fill sealed with the vessel having a pressure between 50-200 mbar, the fill comprising:

a starting gas which comprises: 55-10% argon, 15-5% xenon and 30-5% krypton;

a radioactive Kr85 with a maximum activity level of 0.124 MBq/l as part of the starting gas;

a voltage riser component;

a metal halide component; and an active tungsten regeneration cycle wherein the fill comprises a species of said tungsten or said tungsten alloy of the electrode material during lamp operation, wherein the solubility of tungsten or components of tungsten alloy in said tungsten or tungsten alloy species is lower in the gas phase adjacent to the electrodes than at close proximity of the wall of the discharge vessel.

* * * * *